US006209425B1

(12) United States Patent
Hu

(10) Patent No.: US 6,209,425 B1
(45) Date of Patent: Apr. 3, 2001

(54) DRIVING DEVICE FOR HEXAGONAL WRENCHES

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/126,498

(22) Filed: Jul. 30, 1998

(51) Int. Cl.[7] ..... B25G 1/04; B25B 23/16
(52) U.S. Cl. ..... 81/177.2; 81/177.1
(58) Field of Search ..... 81/177.2, 177.5, 81/177.1, 489, 436, 439

(56) References Cited

U.S. PATENT DOCUMENTS 1,172,656 * 2/1916 Yorgensen ..... 81/177.2
2,870,809 * 1/1959 Feldman et al. ..... 81/177.5
3,850,056 * 11/1974 Allen ..... 81/177.2
4,308,770 * 1/1982 MacDonald ..... 81/177.2
5,592,859 * 1/1997 Johnson et al. ..... 81/177.2
5,765,454 * 6/1998 Barbulescu et al. ..... 81/177.1

* cited by examiner

*Primary Examiner*—David A. Scherbel
*Assistant Examiner*—Joni B. Danganan
(74) *Attorney, Agent, or Firm*—Charles E. Baxley

(57) ABSTRACT

A driving device includes a hollow holding member having one portion that has a retaining section formed on an intermediate section of an inner periphery thereof. The retaining section includes two mutually facing stepped surfaces that together define a tapered space therebetween for securely holding one of two angled sections of a hexagonal wrench. The other portion of the holding member includes a bottom wall that includes a notch defined therein for securely holding the other of the angled sections.

20 Claims, 10 Drawing Sheets

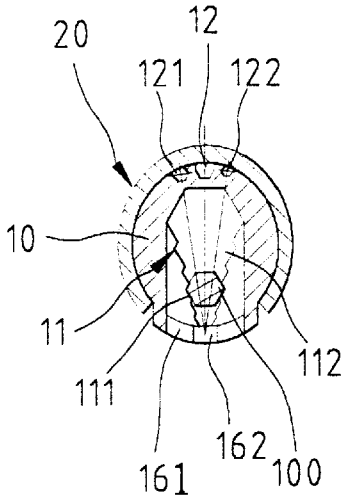
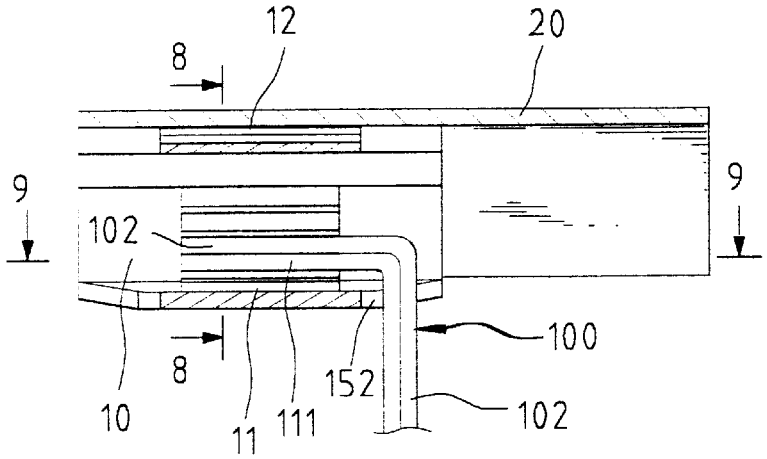
Fig. 8
Fig. 7
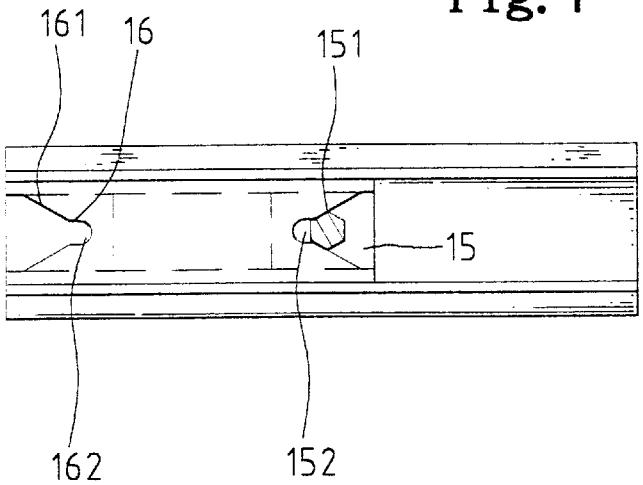
Fig. 9

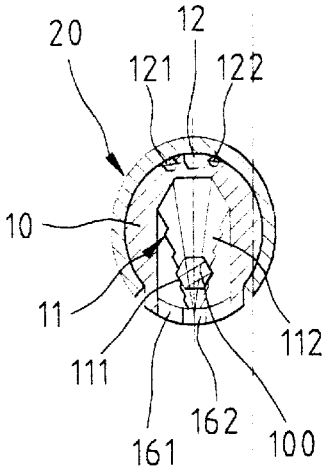
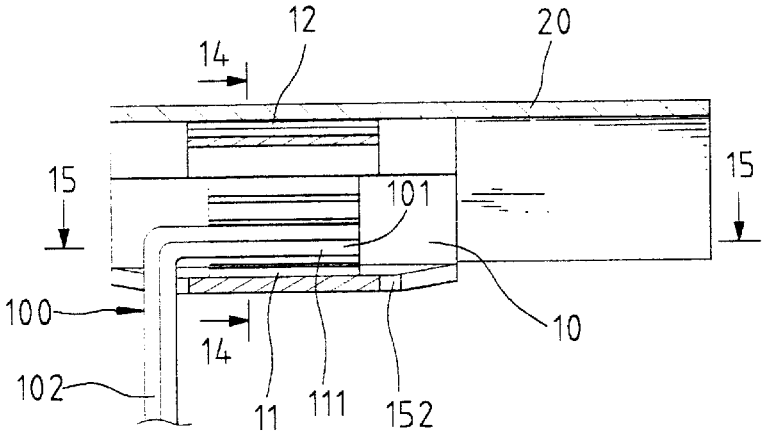
Fig. 14
Fig. 13
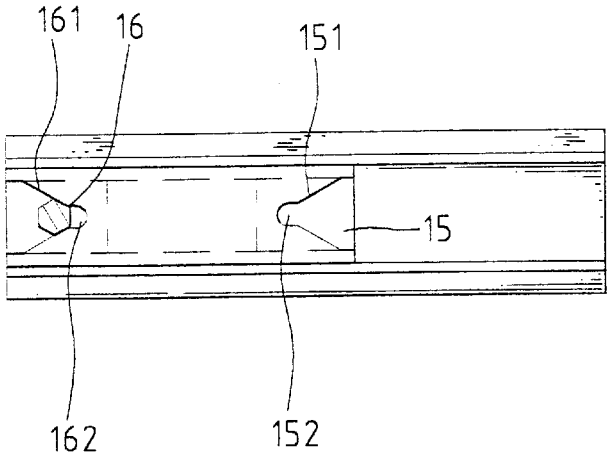
Fig. 15

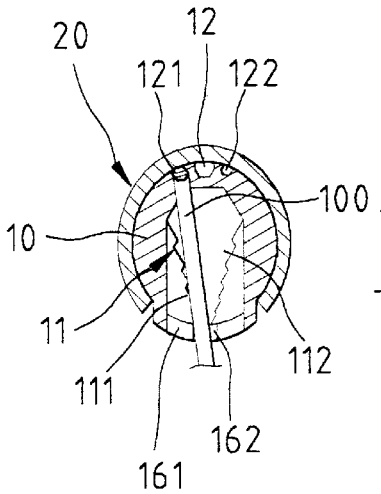
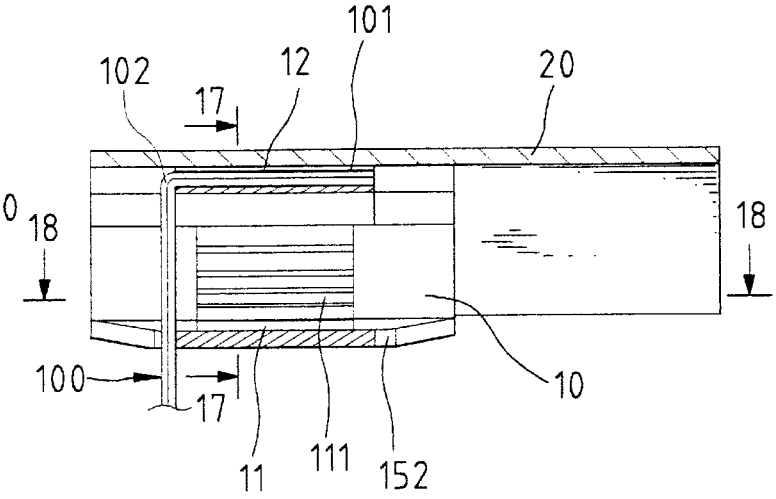
Fig. 17
Fig. 16
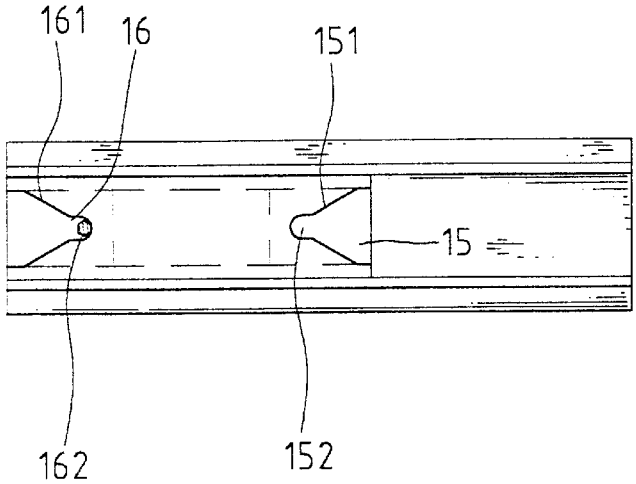
Fig. 18

DRIVING DEVICE FOR HEXAGONAL WRENCHES

BACKGROUND OF THE INVENTION

1. Field of the Invention

The present invention relates to a driving device for hexagonal wrenches of various sizes.

2. Description of the Related Art

Hexagonal wrenches (i.e., Allen wrenches) are used to tighten or fasten bolts or screws of the type having a hexagonal socket in a head portion thereof. However, direct manual operation of the hexagonal wrench is inconvenient, and the six sharp edges of the hexagonal wrench may cause pain to the user's fingers. Devices have been proposed to hold and drive hexagonal wrenches, yet the holding effect is found unsatisfactory as the driving devices merely hold one end of the hexagonal wrench to be operated. The present invention is intended to provide an improved device to solve these problems.

SUMMARY OF THE INVENTION

It is a primary object of the present invention to provide an improved driving device that may hold both of a relatively longer section and a relatively shorter section of a hexagonal wrench to be operated.

A driving device in accordance with the present invention is provided for holding and driving a hexagonal wrench having two angled sections. The driving device comprises a hollow holding member including two portions. One portion of the hollow holding member has a retaining section formed on an intermediate section of an inner periphery thereof. The retaining section includes two mutually facing stepped surfaces that together define a tapered space therebetween for securely holding one of the angled sections of the hexagonal wrench. The stepped surfaces consist of consecutively connected step sections of different lengths, the stepped surfaces defining the tapered space being configured by a plurality of aligned and partially overlapped hexagons of different sizes that are aligned in sequence according to the sizes thereof such that the two mutually facing stepped surfaces are capable of holding hexagonal wrenches of various sizes. The other portion of the holding member includes a bottom wall that includes a notch defined therein for securely holding the other of the angled sections of the hexagonal wrench.

The notch has a central recessed section and two rectilinear sections provided on two sides of the central recessed section, respectively.

The holding member may further include a second retaining section formed on an outer periphery thereof. The second retaining section includes a plurality of spaced longitudinal grooves that extend along a longitudinal direction of the holding member for receiving said one of the angled sections of the hexagonal wrench. In addition, an outer sleeve may be mounted around the holding member to enclose the second retaining section of the holding member.

In an embodiment of the invention, a driving device is provided for holding and driving a hexagonal wrench having two angled sections. The driving device comprises a hollow holding member including two portions and a retaining section formed on an intermediate section of an inner periphery thereof and thus defining two chambers in the ends of the holding member, respectively. The retaining section includes two mutually facing stepped surfaces that together define a tapered space therebetween for securely holding one of the angled sections of the hexagonal wrench. Each end of the holding member further includes a bottom wall that defines a portion of an associated chamber. Each bottom wall includes a notch defined therein for securely holding the other of the angled sections of the hexagonal wrench. Each notch has a central recessed section and two rectilinear sections provided on two sides of the central recessed section, respectively.

The holding member further includes a second retaining section formed on an intermediate section of an outer periphery thereof. The second retaining section includes a plurality of spaced longitudinal grooves that extend along a longitudinal direction of the holding member for receiving said one of the angled sections of the hexagonal wrench. An outer sleeve is mounted around the holding member to enclose the second retaining section of the holding member.

In a second embodiment of the invention, a driving device is provided for holding and driving a hexagonal wrench having two angled sections. The driving device comprises a hollow holding member including a retaining section formed on an inner periphery thereof. The retaining section includes two mutually facing stepped surfaces that together define a tapered space therebetween for securely holding one of the angled sections of the hexagonal wrench. An outer sleeve is securely mounted around the holding member. The outer sleeve includes a bottom wall adjacent to the holding member. The bottom wall includes a notch defined therein for securely holding the other of the angled sections of the hexagonal wrench. The notch has a central recessed section and two rectilinear sections provided on two sides of the central recessed section, respectively. The holding member further includes a second retaining section formed on an intermediate section of an outer periphery thereof. The second retaining section includes a plurality of spaced longitudinal grooves that extend along a longitudinal direction of the holding member for receiving said one of the angled sections of the hexagonal wrench.

Other objects, advantages, and novel features of the invention will become more apparent from the following detailed description when taken in conjunction with the accompanying drawings.

BRIEF DESCRIPTION OF THE DRAWINGS

FIGS. 7–9, 10–12, 13–15, and 16–18 each are sectional views similar to FIGS. 4–6, respectively, illustrating application of the driving device on hexagonal wrenches of different sizes;

DETAILED DESCRIPTION OF THE PREFERRED EMBODIMENT

Figure 1:
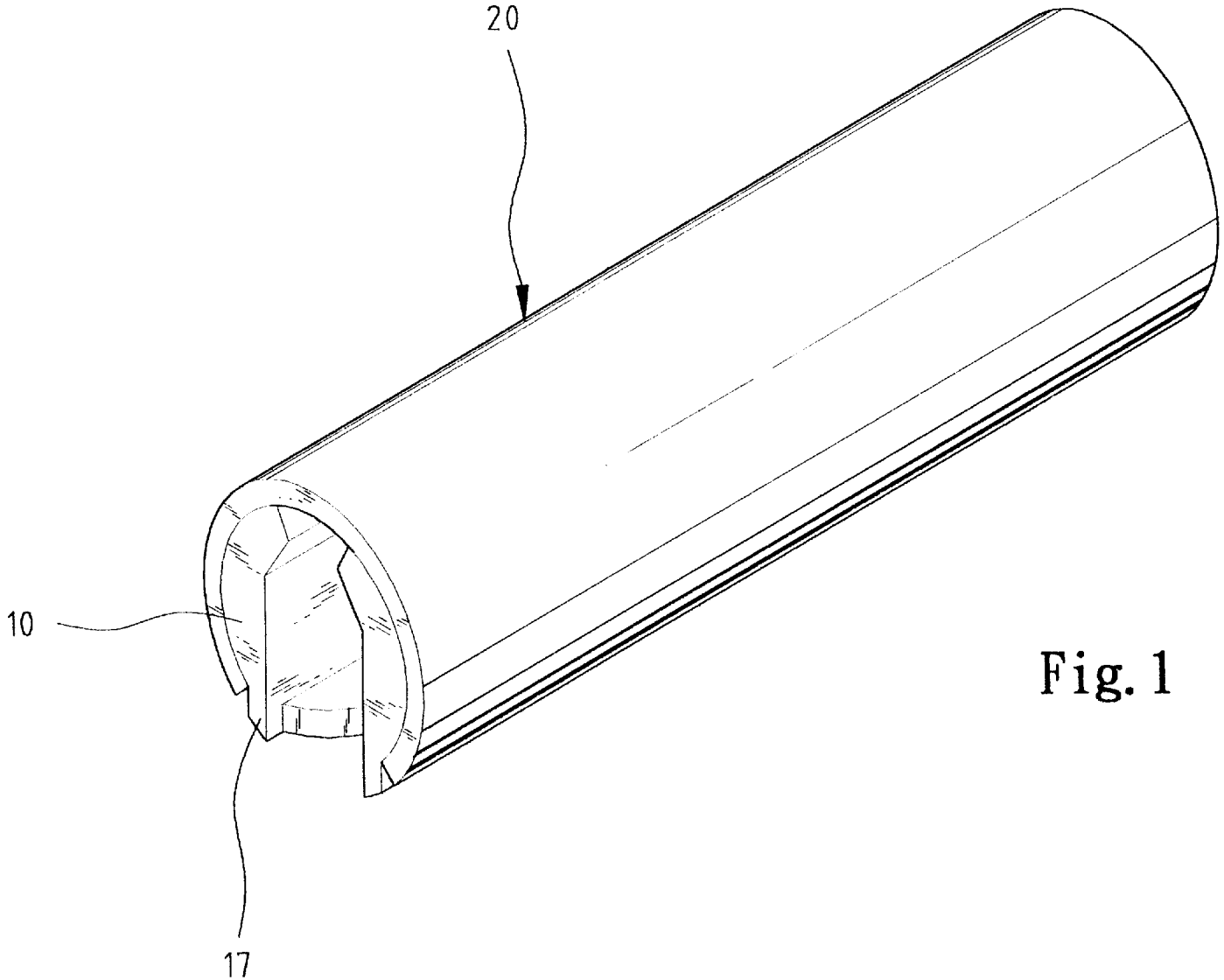
FIG. 1 is a perspective view of a first embodiment of a driving device for hexagonal wrenches in accordance with the present invention.
Figure 2:
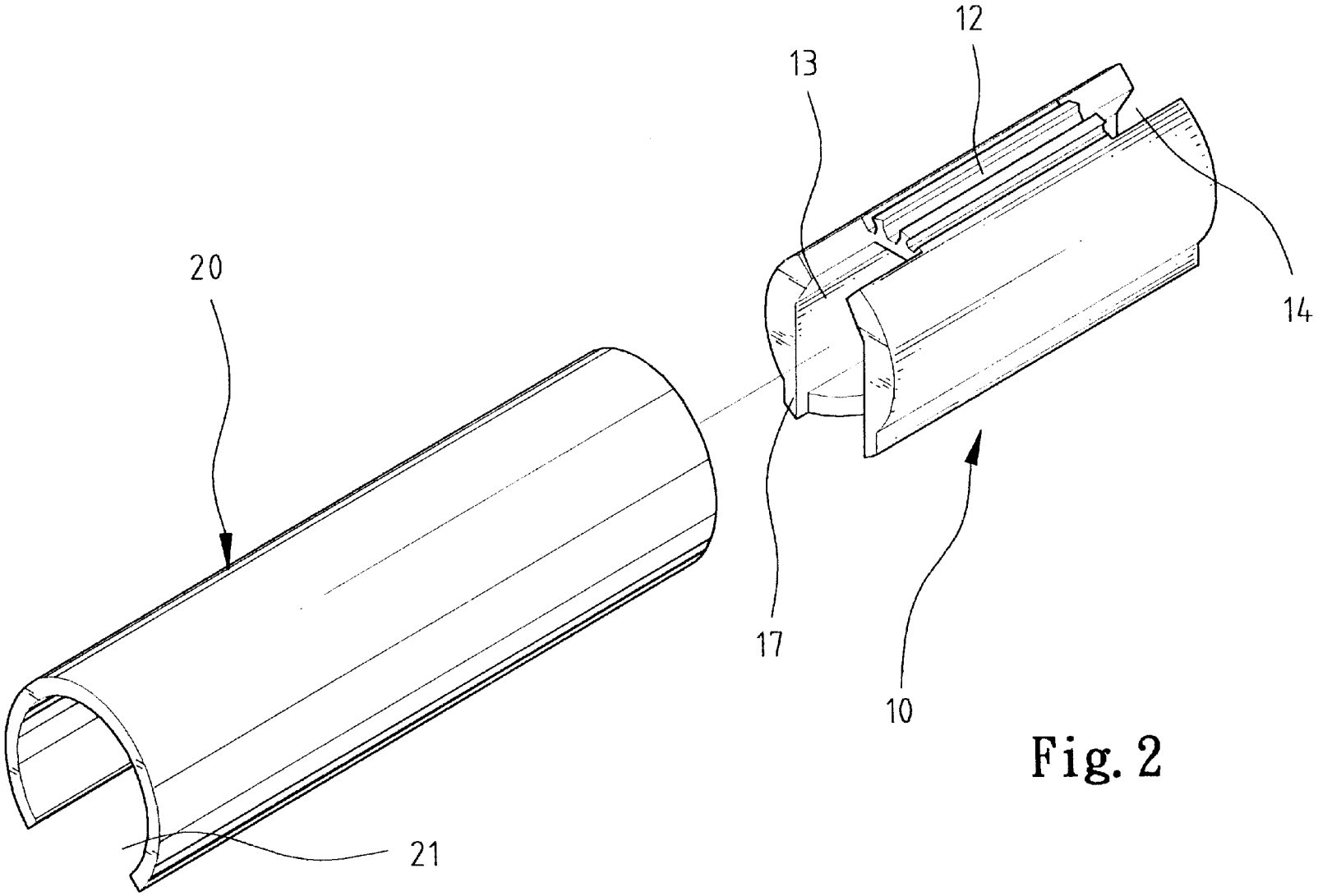
FIG. 2 is an exploded perspective view of the driving device.
Figure 3:
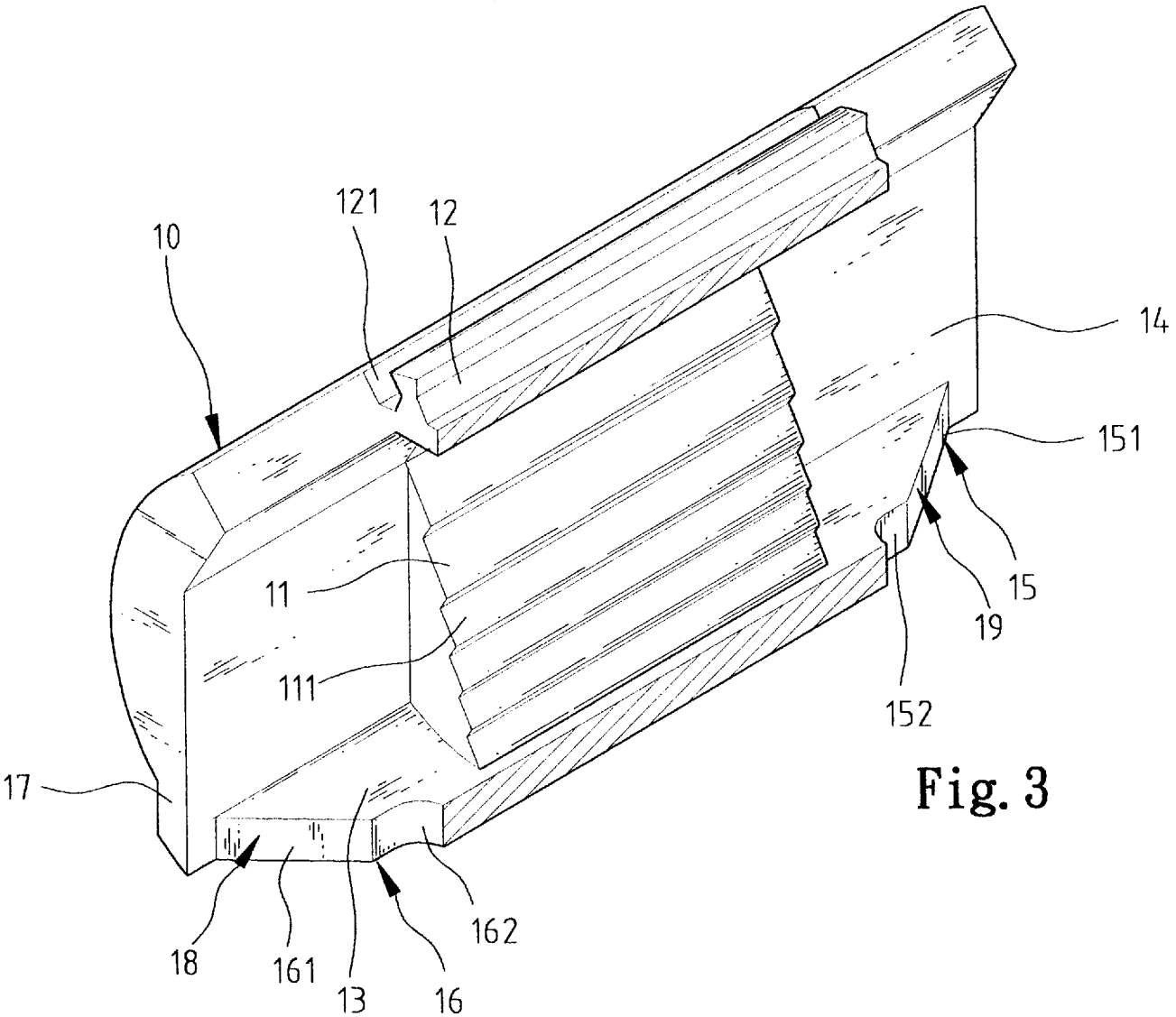
FIG. 3 is a perspective view of a holding member of the driving device, which is partly cutaway to show detailed structure.
Figure 5:
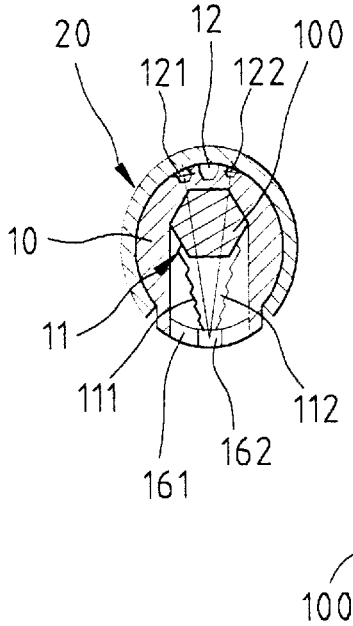
FIG. 5 is a sectional view taken along line 5—5 in FIG. 4.

Referring to the drawings and initially to FIGS. 1 to 3, a driving device for hexagonal wrenches in accordance with the present invention generally includes an outer sleeve 20 and a holding member 10 securely held in a compartment 21 in the outer sleeve 20 (C-shaped in this embodiment). The holding member 10 is substantially a hollow cylinder and includes a first retaining section 11 formed on an intermediate section of an inner periphery thereof and thus defining a first chamber 13 and a second chamber 14 in two ends of the holding member 10, respectively. As shown in FIGS. 3 and 5, the first retaining section 11 includes two mutually facing stepped surfaces 111 that together define a tapered space 112 therebetween. It is appreciated that each step of the stepped surfaces 111 is oblique and extends in a direction having an angle with a longitudinal, vertical plane on which the longitudinal axis of the holding member 10 is located (FIG. 5). In addition, each end of the holding member 10 further includes a bottom wall 18, 19 that defines a portion of the associated chamber 13, 14. Each bottom wall 18, 19 includes a notch 16, 15 having a central recessed section 162, 152 and two rectilinear sections 161, 151 provided on two sides of the central recessed section 162, respectively, best shown in FIGS. 3 and 6. The holding member 10 may further include a second retaining section 12 formed on an intermediate section of an outer periphery thereof. The second retaining section 12 includes a number of spaced longitudinal grooves 121 and 122 (FIG. 5) that extend along a longitudinal direction of the holding member 10. The holding member 10 may be formed by extrusion or power metallurgic process, while the outer sleeve 20 may be made of steel.

In assembly, as shown in FIGS. 1 and 2, the holding member 10 is fittingly held by the outer sleeve 20, with two protruded portions 17 of the holding member 10 extending outside the sleeve 20.

Figure 4:
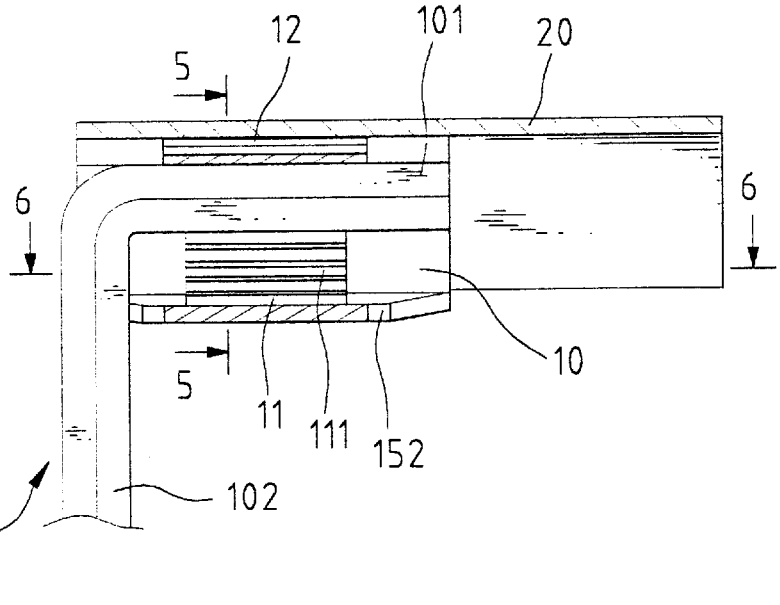
FIG. 4 is a longitudinal sectional view of the driving device in use.
Figure 6:
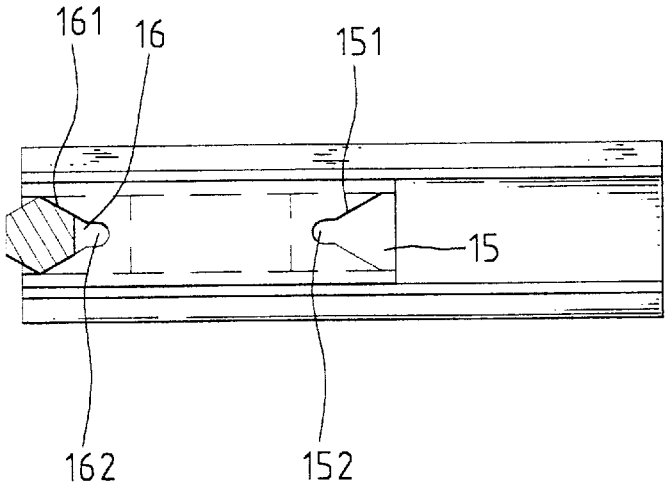
FIG. 6 is a sectional view taken along line 6—6 in FIG. 4.
Figure 11:
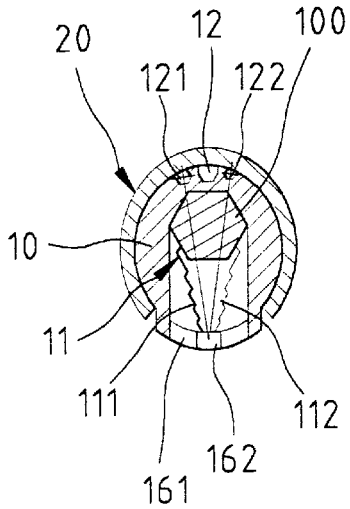
Figure 10:
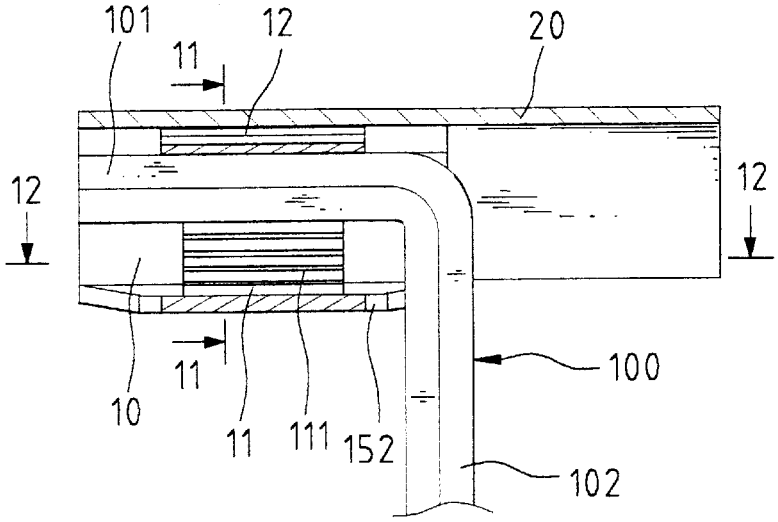
Figure 12:
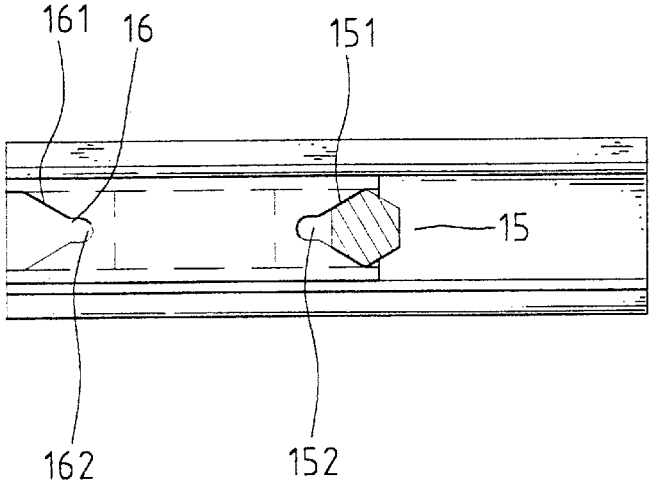

In use, as shown in FIGS. 4 to 6, a relatively shorter section 101 of an Allen wrench 100 is securely held by the first retaining section (FIG. 5), while a relatively longer section 102 of the Allen wrench 100 is securely held by the rectilinear sections 161 of the notch 16 (FIG. 6). Thus, the holding member 10 securely holds both sections 101 and 102 of the Allen wrench 100, which is more reliable than conventional designs. FIGS. 7 to 15 are schematic views illustrating application of the driving device of the present invention to Allen wrenches of other sizes.

Referring to FIGS. 16 to 18, for a relatively small Allen wrench, the relatively shorter section 101 of the Allen wrench 100 is securely held by the second retaining section (FIGS. 16 and 17), while the relatively longer section 102 of the Allen wrench 100 is securely held by the central recessed section 162 of the notch 16 (FIG. 18). Thus, the holding member 10 securely holds both sections 101 and 102 of the Allen wrench 100 of a relatively small size.

It is appreciated that the bottom wall 19 and the notch 15 may be omitted.

Figure 19:
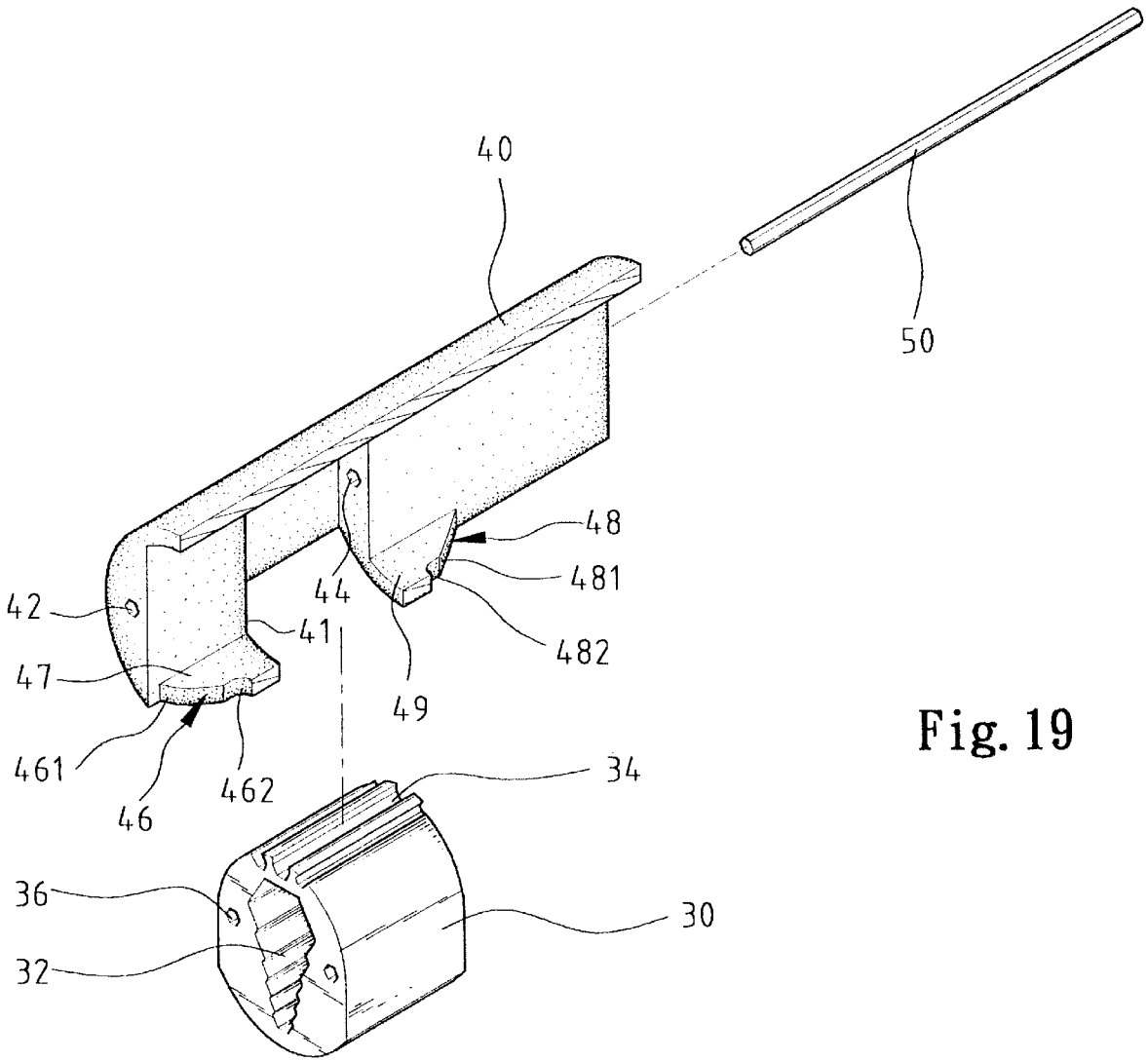
FIG. 19 is an exploded perspective view partly cutaway, of a second embodiment of the driving device in accordance with the present invention.
Figure 20:
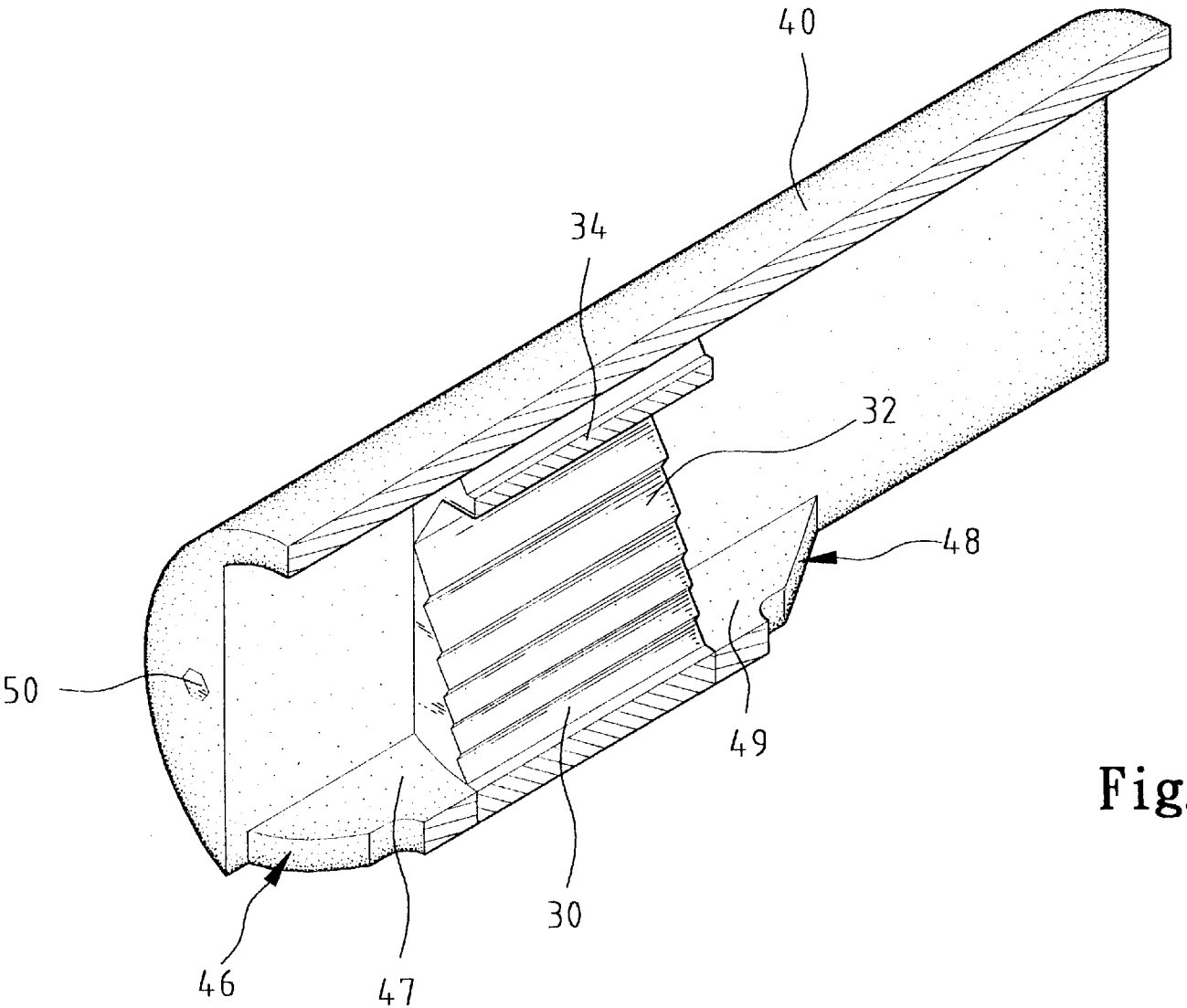
FIG. 20 is a perspective view illustrating a half portion of the driving device in FIG. 19.

FIGS. 19 and 20 illustrates a second embodiment of the driving device of the present invention. In this embodiment, the driving device includes a holding member 30 that includes a first retaining section 32 defined in an inner periphery thereof and a second retaining section 34 defined in an outer periphery thereof. The first retaining section 32 and the second retaining section 34 are identical to the first retaining section 11 and the second retaining section 12 in the first embodiment and therefore not further described. The holding member 30 further includes at least one longitudinal hole 36 defined therein. The driving device further includes an outer sleeve 40 that includes a recess 41 (FIG. 19) defined in an inner periphery thereof for receiving the holding member 30. The outer sleeve 40 includes two bottom walls 47 and 49 provided on both sides of the recess 41, respectively. Each bottom wall 47, 49 includes a notch 46, 48 defined therein. Each notch 46, 48 has a central recessed section 462, 482 and two rectilinear sections 461, 481 provided on two sides of the central recessed section 462, 482 respectively. Operation of the first retaining section 32, the second retaining section 34, and the notches 46 and 48 are identical to that of the first embodiment. Namely, the angled sections (i.e., the relatively shorter section and the relatively longer section) of an Allen wrench can be respectively, securely held by one of the notches 46 and 48 and one of the first retaining section 32 and the second retaining section 34, as described above. The outer sleeve 40 may include at least one longitudinal hole (see aligned holes 42 and 44 in FIG. 19) that aligns with the longitudinal hole 36 of the holding member 30 received in the recess 41, and a steel rod 50 may be extended through the holes 42 and 44 as well as 36 to secure the holding member 30 to the outer sleeve 40. The holding member 30 is made by power metallurgic process, while the outer sleeve 40 can be formed of plastic material to reduce weight. The steel rod 50 may increase strength and provide increased torque when holding and driving an Allen wrench. Operation of the second embodiment of the driving device is identical to the first embodiment and therefore not redundantly described.

Although the invention has been explained in relation to its preferred embodiment, it is to be understood that many other possible modifications and variations can be made without departing from the spirit and scope of the invention as hereinafter claimed.

What is claimed is:

1. A driving device for holding and driving a hexagonal wrench having two angled sections, the driving device comprising:

a hollow holding member including a first portion and a second portion, the first portion of the hollow holding member having a retaining section formed by two mutually facing stepped surfaces that together define a tapered space therebetween for securely holding one of the angled sections of the hexagonal wrench, each said stepped surface consisting of consecutively connected step sections of different lengths, the stepped surfaces defining the tapered space being configured by a plurality of aligned and partially overlapped hexagons of different sizes are aligned in sequence according to the sizes thereof such that the two mutually facing stepped surfaces are capable of holding hexagonal wrenches of various sizes, the second portion of the holding member including a wall, the wall including a notch defined therein for securely holding the other of the angled sections of the hexagonal wrench.

2. The driving device according to claim 1, wherein said notch has a central recessed section and two rectilinear sections provided on two sides of the central recessed section, respectively.

3. The driving device according to claim 1, wherein said holding member further includes a second retaining section formed on an outer periphery thereof, the second retaining section including a plurality of spaced longitudinal grooves that extend along a longitudinal direction of the holding member for receiving said one of the angled sections of the hexagonal wrench.

4. The driving device according to claim 3, further comprising an outer sleeve mounted around the holding member to enclose the second retaining section of the holding member.

5. A driving device for holding and driving a hexagonal wrench having two angled sections, the driving device comprising:

a hollow holding member including a first portion, a second portion, and an intermediate section, each of the first portion and the second portion including a chamber defined therein, the intermediate section including a retaining section formed by two mutually facing stepped surfaces that together define a tapered space therebetween for securely holding one of the angled sections of the hexagonal wrench, each said stepped surface consisting of consecutively connected step sections of different lengths, the stepped surfaces defining the tapered space being configured by a plurality of aligned and partially overlapped hexagons of different sizes that are aligned in sequence according to the sizes thereof such that the two mutually facing stepped surfaces are capable of holding hexagonal wrenches of various sizes, a wall that defines a portion of an associated said chamber including a notch defined therein for securely holding the other of the angled sections of the hexagonal wrench.

6. The driving device according to claim 5, wherein each said notch has a central recessed section and two rectilinear sections provided on two sides of the central recessed section, respectively.

7. The driving device according to claim 5, wherein the holding member further includes a second retaining section formed on an outer periphery thereof, the second retaining section includes a plurality of spaced longitudinal grooves that extend along a longitudinal direction of the holding member for receiving said one of the angled sections of the hexagonal wrench.

8. The driving device according to claim 7, further comprising an outer sleeve mounted around the holding member to enclose the second retaining section of the holding member.

9. A driving device for holding and driving a hexagonal wrench having two angled sections, the driving device comprising:

a hollow holding member including a retaining section formed on an inner periphery thereof, the retaining section including two mutually facing stepped surfaces that together define a tapered space therebetween for securely holding one of the angled sections of the hexagonal wrench, each said stepped surface consisting of consecutively connected step sections of different lengths, the stepped surfaces defining the tapered space being configured by a plurality of aligned and partially overlapped hexagons of different sizes that are aligned in sequence according to the sizes thereof such that the two mutually facing stepped surfaces are capable of holding hexagonal wrenches of various sizes, and an outer sleeve securely mounted around the holding member, the outer sleeve including a wall adjacent to the holding member, the wall including a notch defined therein for securely holding the other of the angled sections of the hexagonal wrench.

10. The driving device according to claim 9, wherein said notch has a central recessed section and two rectilinear sections provided on two sides of the central recessed section, respectively.

11. The driving device according to claim 9, wherein the holding member further includes a second retaining section formed on an outer periphery thereof, the second retaining section includes a plurality of spaced longitudinal grooves that extend along a longitudinal direction of the holding member for receiving said one of the angled sections of the hexagonal wrench.

12. A driving device for holding and driving a hexagonal wrench having two angled sections, the driving device comprising:

a hollow holding member including a first portion and a second portion, the first portion of the hollow holding member having a retaining section formed by two mutually facing stepped surfaces that together define a tapered space therebetween for securely holding one of the angled sections of the hexagonal wrench, the second portion of the holding member including a wall that includes a notch defined therein for securely holding the other of the angled sections of the hexagonal wrench, the notch having a central recessed section and two rectilinear sections provided on two sides of the central recessed section, respectively.

13. A driving device for holding and driving a hexagonal wrench having two angled sections, the driving device comprising:

a hollow holding member including a first portion and a second portion, the first portion of the hollow holding member having a retaining section formed by two mutually facing stepped surfaces that together define a tapered space therebetween for securely holding one of the angled sections of the hexagonal wrench, the second portion of the holding member including a wall that includes a notch defined therein for securely holding the other of the angled sections of the hexagonal wrench, the holding member further including a second retaining section formed on an outer periphery thereof, the second retaining section including a plurality of spaced longitudinal grooves that extend along a longitudinal direction of the holding member for receiving said one of the angled sections of the hexagonal wrench.

14. The driving device according to claim 13, further comprising an outer sleeve mounted around the holding member to enclose the second retaining section of the holding member.

15. A driving device for holding and driving a hexagonal wrench having two angled sections, the driving device comprising:

a hollow holding member including a first end, a second end, and an intermediate section, the intermediate section including a retaining section formed on an inner periphery thereof, each of the first end and the second end of the hollow holding member including a chamber, the retaining section including two mutually facing stepped surfaces that together define a tapered space therebetween for securely holding one of the angled sections of the hexagonal wrench, a wall that defines a portion of each said chamber including a notch defined therein for securely holding the other of the angled sections of the hexagonal wrench.

16. The driving device according to claim 15, wherein each said notch has a central recessed section and two rectilinear sections provided on two sides of the central recessed section, respectively.

17. The driving device according to claim 15, wherein the holding member further includes a second retaining section formed on an outer periphery thereof, the second retaining section includes a plurality of spaced longitudinal grooves that extend along a longitudinal direction of the holding member for receiving said one of the angled sections of the hexagonal wrench.

18. The driving device according to claim 17, further comprising an outer sleeve mounted around the holding member to enclose the second retaining section of the holding member.

19. A driving device for holding and driving a hexagonal wrench having two angled sections, the driving device comprising:

a hollow holding member including a retaining section formed on an inner periphery thereof, the retaining section including two mutually facing stepped surfaces that together define a tapered space therebetween for securely holding one of the angled sections of the hexagonal wrench, and an outer sleeve securely mounted around the holding member, the outer sleeve including a wall adjacent to the holding member, the wall including a notch defined therein for securely holding the other of the angled sections of the hexagonal wrench, the notch having a central recessed section and two rectilinear sections provided on two sides of the central recessed section, respectively.

20. A driving device for holding and driving a hexagonal wrench having two angled sections, the driving device comprising:

a hollow holding member including a retaining section formed on an inner periphery thereof, the retaining section including two mutually facing stepped surfaces that together define a tapered space therebetween for securely holding one of the angled sections of the hexagonal wrench, and an outer sleeve securely mounted around the holding member, the outer sleeve including a wall adjacent to the holding member, the wall including a notch defined therein for securely holding the other of the angled sections of the hexagonal wrench, the holding member further including a second retaining section formed on an outer periphery thereof, the second retaining section including a plurality of spaced longitudinal grooves that extend along a longitudinal direction of the holding member for receiving said one of the angled sections of the hexagonal wrench.

* * * * *